United States Patent [19]

Van Gilder et al.

[11] Patent Number: 4,567,099

[45] Date of Patent: Jan. 28, 1986

[54] HIGH SOLIDS LATEXES FOR PAPER COATINGS

[75] Inventors: Ron L. Van Gilder; Do I. Lee, both of Midland, Mich.

[73] Assignee: The Dow Chemical Company, Midland, Mich.

[21] Appl. No.: 684,876

[22] Filed: Dec. 21, 1984

[51] Int. Cl.[4] ..... B32B 27/10

[52] U.S. Cl. ..... 428/327; 427/358; 428/511; 428/537.5; 523/201; 523/220; 523/221; 524/526

[58] Field of Search ..... 425/511, 327, 537.5; 427/358; 523/201, 220, 221; 524/526

[56] References Cited

U.S. PATENT DOCUMENTS 4,474,860 10/1984 Van Gilder et al. ..... 428/511

*Primary Examiner*—Marion C. McCamish

[57] ABSTRACT

Bimodal latexes having two separate and distinct particle size distributions have high solids content, good high shear rheology and good low shear viscosity. The large size polymer particles of the bimodal latex have a heterogeneous character. These bimodal latexes, e.g., styrene/butadiene/acrylic acid/itaconic acid latexes are employed in coating paper in conjunction with a mineral filler using a coating device such as a blade coater to yield high quality, glossy coatings which can be easily applied.

24 Claims, No Drawings

HIGH SOLIDS LATEXES FOR PAPER COATINGS

BACKGROUND OF THE INVENTION

This invention relates to latexes and latex coatings.

Paper is often filled with mineral fillers such as clay, calcium carbonate and titanium dioxide. Such fillers are used to increase the opacity of the paper product. It is also advantageous to employ coatings and/or binders in the paper making process. For example, synthetic latexes or natural binders such as proteins or starch are employed as coatings alone or as components of pigmented coatings to increase the strength of the paper. The use of synthetic latexes as binders has become popular due to the desirable properties exhibited by said latexes.

Coatings are often applied to continuous web materials such as paper through the use of a high speed coating devices. For example, when a blade coater is employed, the properties of the coating which is applied to the paper can be varied by altering the blade thickness or the blade angle of the coater, the amount of pressure employed in forcing the coating material through the blade, or the rheology of the coating itself.

It is desirable that latexes which are applied using coating devices remain as discrete, stable, free moving particles in order to obtain trouble-free runability. However, when a latex containing coating formulation is subjected to high shear, such as, for example, in a blade coater, the formulation can exhibit a shear thinning or shear thickening behavior. Shear thickening can be reduced by decreasing the solids content in the coating formulation. Although a reduction in the amount of solids will improve the runability of the formulation, the quality of the resulting coating can be adversely affected by low coating weight or excess "diving in" of the coating into the paper substrate. It is desirable to have greater coating "hold-out" on the surface of the paper so as to achieve paper exhibiting improved printing quality.

Coating formulations which are increasingly high in solids facilitate the production of high quality coatings. Typically, high solids coatings are obtained by adding dry pigment to pigment slurries. However, a high solids latex reduces or eliminates the need for dry pigment addition. In addition, high solids coatings are desirable in increasing production rates and reducing energy costs. High solids versions of conventional latexes are limited to their use as paper coatings due to the resulting high coating formulation viscosity at high shear rates. This leads to poor blade coater runability. Typically, poor runability is characterized by scratching or streaking of the coating, or lack of coat weight control (i.e., very high weight coatings and/or uneven coatings).

Improved high solids formulations for coating paper are disclosed in U.S. Pat. No. 4,474,860. The disclosed formulations comprise a high solids synthetic bimodal latex comprising two separate and distinct particle size distributions of styrene/butadiene type latexes. Such formulations are disclosed as exhibiting good runability during application using a device such as a blade coater. However, it would be desirable to provide a formulation for coating paper which, in addition to the previously described desirable properties, exhibits high sheet gloss when applied to paper, exhibits a high ink gloss after inking of paper is performed, exhibits a high porosity and ink receptivity when applied to paper, and exhibits good binding strength.

In view of the deficiencies in the prior art, and in view of the desirability of providing improved paper coating formulations, it would be highly desirable to provide a means of preparing a paper coated with a formulation comprising a high solids synthetic latex which exhibits good runability during application with a device such as a blade coater.

SUMMARY OF THE INVENTION

The present invention is a composition comprising an aqueous medium having dispersed therein a synthetic bimodal polymer latex comprising two separate and distinct particle size distributions of large size particles and small size particles, wherein each of said distributions comprises particles which are of a substantially uniform diameter; wherein the large size particles comprise particles which are heterogeneous in nature having a soft polymer domain and a hard polymer domain.

The present invention in another aspect is a high solids formulation for coating paper which comprises an aqueous medium having dispersed therein a functionally effective amount of a finely divided mineral filler and a high solids synthetic bimodal latex comprising two separate and distinct particle size distributions; wherein each of said distributions comprises particles which are substantially uniform in diameter such that said latex, when mixed with said filler in said aqueous medium, provides a coating formulation which approaches a viscosity which is no longer manageable at a higher solids content than that solids content exhibited by a formulation comprising an aqueous medium, a filler and a monodisperse or highly multi-disperse latex. The small latex particles of said distribution of the bimodal latex provides an increase in the solids content and a decrease in viscosity at high shear of the formulation over that of a formulation comprising a monodisperse latex of a particle size similar to that of the large latex particle distribution of the bimodal latex. The large latex particle of said distribution of the bimodal latex are heterogeneous in nature and are capable of increasing the solids content of the formulation at low shear over that of a formulation comprising a monodisperse latex of a particle size similar to that of the small latex particle distribution of the bimodal latex.

In another aspect, the present invention is a process for coating paper which comprises applying the formulation of this invention to said paper using a coating device. In yet another aspect, this invention is a coated article comprising a fibrous sheet continuously coated on at least one surface with the formulation of this invention.

The process of this invention yields improved coating compositions which are high in solids and thus provide a high quality paper. In addition, the process of this invention provides a method for easily applying latex coatings to paper due to the low viscosity, good runability and good high shear rheology provided by the bimodal latex.

For purposes of this invention, the term, "high solids" is used in referring to a formulation comprising a dispersed phase and a continuous phase wherein the volume fraction of the dispersed phase approaches the limit at which the formulation no longer exhibits a manageable viscosity. Similarly, by the term, "latex with a high solids content" is meant a latex formulation comprising latex particles in amounts such that the formulation approaches the limit at which said formulation no longer exhibits a manageable low shear viscosity. Similarly, by the term, "high solids coatings" is meant a coating formulation which can comprise solids such as natural binders, clays, synthetic latexes, etc. which, for a particular formulation, contains solids in amounts such that the formulation approaches a limit at which said formulation no longer exhibits a manageable high shear viscosity. By the term "viscosity which is no longer manageable" is meant that the formulation is too thick to handle and use in standard paper coating procedures.

DETAILED DESCRIPTION OF THE INVENTION

The bimodal latex of this invention comprises a proportion of large size latex particles and a proportion of small size latex particles. It is desirable to employ large size particles whose diameter is in the range of from about 2.5 to about 10, most preferably from about 3 to about 4, times that diameter of the small size particles. It is also desirable that the weight percentage of large size particles in the latex formulation exceed the weight percentage of the small size particles. For example, a latex composition comprised substantially of styrene/-butadiene comprising from about 50 to about 98, preferably from about 60 to about 80, weight percent large size particles and from about 2 to about 50, preferably from about 20 to about 40, weight percent small size particles can be used. It is understood that the proportion of large size particles and the proportion of small size particles, the size distribution of particles, and the amount of solids in the formulation employed can depend on the particular latex which is employed and/or the particular coating device which is employed.

The large size latex particles can vary in size from about 1500 Å to about 10,000 Å, more preferably from about 1800 Å to about 3000 Å in diameter. The small size latex particle can vary in size from about 500 Å to about 1000 Å, more preferably from about 600 Å to about 800 Å in diameter.

Critical to this invention is the use of heterogeneous polymer particles in providing the large size polymer particles of the bimodal latex. Of particular interest are the types of polymer particles disclosed in U.S. Pat. No. 4,134,872, which is incorporated herein by reference. That is, the heterogeneous polymer particles are characterized as having a hard resinous polymer of interpolymer forming a core or core-type region, and a soft preferably interpolymer shell or shell-type region. Also useful herein are the coalescence capable heterogeneous polymer particles, which particles have hard core or core-type regions and soft shell or shell-type regions, and which are of the type disclosed in U.S. patent application Ser. No. 543,198, filed Oct. 19, 1983.

Broadly speaking, the large size heterogeneous polymer particles have a relatively soft polymer domain and a relatively hard polymer domain. It is believed that the hard polymer domain provides a desirable gloss characteristic to the coating formulation; while the soft, deformable polymer domain provides a desirable binding characteristic to the coating formulation.

The heterogeneous polymer particles typically comprise from about 10 to about 90, preferably about 40 to about 75 weight percent of a hard polymer domain, and about 10 to about 90, preferably about 25 to about 60 weight percent of a soft polymer domain. Generally, the hard polymer domain comprises from about 80 to about 100 weight percent types of monomers (e.g., monovinylidene aromatic monomers) which form a hard component of the hard polymer domain when polymerized; from about 0 to about 20 weight percent, preferably from about 10 to about 20 weight percent monomers such as open chain aliphatic conjugated diene monomers or other such monomers which when polymerized provide a softening character to the hard domain; and from about 0 to about 10, preferably about 0.5 to about 5 weight percent of a hydrophilic, hydrolyzable or ionizable monomer such as acrylic acid. Generally, the soft polymer domain comprises from about 30 to about 70, preferably about 40 to about 60 weight percent of a monoethylenically unsaturated monomer which (e.g., a monomer which can form a hard component of the polymer domain such as a monovinylidene aromatic monomer, or a monomer which can form a soft component of the soft polymer domain such as an acrylate monomer, or a combination thereof); from about 70 to about 30, preferably from about 60 to about 40 weight percent of a soft monomer such as a conjugated open chain diene; and from about 0.1 to about 10, preferably about 2 to about 6 weight percent of a hydrophilic, hydrolyzable or ionizable monomer. Typically, the minimum film formation temperature of the latex composition is less than about 30° C. Preferred heterogeneous polymer particles comprise carboxylated monovinylidene/conjugated diene containing polymer particles. For example, carboxylated styrene/butadiene containing polymer particles having a heterogeneous character are particularly useful.

The small size polymer particles of this invention are prepared from combinations of monomers such that the resulting particles have sufficient adhesive properties for paper coating binding applications. Virtually any latex that can be used as a paper coating binder and can be prepared for use in a bimodal composition can be employed. It is also desirable that the latex be carboxylated in order to increase colloidal stability and, hence, the degree of binding efficiency to the paper and pigments. Examples of suitable monomers for providing a carboxylate character include acrylic acid, methacrylic acid, itaconic acid and fumaric acid. Typically, the minimum film formation temperature of the latex composition is less than about 25° C. Representative monomers useful in preparing the latexes of this invention and methods for preparing the individual separate particles are described in U.S. Pat. Nos. 3,404,116 and 3,399,080, which are incorporated herein by reference. Examples of monomers suitable for preparing the latexes of this invention can include the olefins such as ethylene and propylene, vinyl acetate, alkyl acrylates, hydroxyalkyl acrylates, alkyl methacrylates, hydroxyalkyl methacrylates, acrylamide, n-methyloylacrylamides, as well as monomers such as vinyl chloride and vinylidene chloride. Especially preferred latexes include modified styrene/butadiene latexes such as, for example, styrene/butadiene/acrylic acid, styrene/butadiene/acrylic acid/itaconic acid, styrene/butadiene/vinylidene chloride, styrene/butadiene/-β-hydroxyethyl acrylate, styrene/butadiene/β-hydroxyethylacrylate/acrylic acid, styrene/n-butylacrylate/acrylic acid, methyl methacrylate/n-butylacrylate/acrylic acid, vinyl acetate/acrylic acid, vinyl acetate/n-butylacrylate/acrylic acid, and/or styrene/n-butyl acrylate/-butadiene/acrylic acid. Mixtures of carboxylic acids can be employed in the aforementioned latexes.

In the preparation of the small particle size polymer latexes, it is desirable to use a relatively small polymer particle (e.g., a "seed" latex) in initiating particle formation. The latexes having separate and distinct particle sizes are then blended together to yield a bimodal latex composition. Alternatively, bimodal latexes can be prepared by intermediate addition of a seed latex during the heterogeneous particle emulsion polymerization process. For example, the core domain of the large size particle can be prepared, and either simultaneously to or after the shell domain of the large size particle is formed, the seed latex can be added in order to provide large size heterogeneous polymer particles having a hard core domain and a soft shell domain, and small size polymer particles having a soft character which is similar to that shell character of the large size particles. Any of the latex formulations can be concentrated, if desired.

The process of this invention offers a balance between two desirable properties. It is desirable that the runability of the latex be good for easy and effective application using a coating device. That is, it is desirable that the viscosity of the latex be low at high rates of shear. This is generally accomplished by employing latexes in a small particle size range. However, it is also desirable that the latex be of high solids. High solids latexes typically are composed of particles of relatively large size and that have a broad particle size distribution. However, such large size particles do not exhibit a tendency to move well relative to one another under conditions of high shear. On the other hand, the bimodal latex exhibits high solids content with an acceptably high low shear viscosity. For purposes of this invention, "low shear" means shear rates of less than about 1000 $sec^{-1}$. Conversely, by "high shear" is meant shear rates of more than about 10,000 $sec^{-1}$. Typically, the use of a bimodal latex, as described herein, as in a coating formulation results in superior coating runability over that of the corresponding large monodisperse particle size latex. As a result, higher coating formulation solids can be used with the bimodal latexes than those prepared with the corresponding monodisperse latex. In addition, the bimodal latexes yield coating formulations which exhibit coating runability (i.e., low viscosity at high shear) which is comparable or better than that of a conventional small particle size, monodisperse latex.

Coating formulations of this invention comprise an aqueous medium, an amount of a finely divided mineral filler and a bimodal latex. Examples of mineral fillers include those known in the art such as clay, titanium dioxide, etc. The amount of filler which is employed can vary, depending upon the density of the filler and the coating properties desired. Typically, coating formulations comprise about 100 parts filler and about 2 to about 20, preferably about 14 to about 18, parts of bimodal latex by weight. Each of the aforementioned components is mixed in an aqueous medium to yield a formulation which is about 60 to about 75 percent solids by weight. Typically, coating formulations of this invention are at least about 1 percent higher in solids than those formulations comprising monodisperse or highly multi-disperse latexes and exhibiting comparable viscosities. It is also understood that other additives known in the art which include cobinders, thickeners, water retention aids and the like can be added to the coating formulation. Such additives are disclosed in the aforementioned U.S. Pat. No. 3,399,080.

The coatings as described herein are most desirably applied to the paper through coating devices such as blade coaters which are described in *Coating Equipment and Processes,* O. L. Booth, Lookwood Publishing Co., Inc., 1970. The process of this invention yields an improved method of applying latex coating formulations to paper, for example, as binders, colorants, etc. Other methods for applying coatings to paper can include the use of coating devices such as air knife coaters, rod coaters, roll coaters, and the like, which are described in the aforementioned reference.

Bimodal latexes are most advantageously employed as excellent coatings for paper. Particularly interesting are those applications where high-solids formulations are useful in the production of fine quality, high gloss paper. The high solids coatings comprising the high solids latex compositions of this invention exhibit superior sheet gloss and ink gloss, porosity and ink receptivity as compared to high gloss latex-containing coatings comprising monodisperse or highly multidisperse latex particles, when comparable coat weights are employed. However, such latexes can also be employed in a wide variety of end-use applications such as in coating formulations such as paints, as impregnants, and in adhesive compositions. In such instances, the bimodal latexes are suitably employed pursuant to known techniques and procedures which are conventionally employed with other types of latexes in the chosen type of end-use application.

The following examples are given for the purpose of illustrating the present invention and are not to be construed as limiting its scope. Unless otherwise indicated, all parts and percentages are by weight.

EXAMPLE 1

A two-stage latex is prepared having 72.3 parts of a styrene/butadiene/acrylic acid monomer first stage and 27.3 parts of styrene/butadiene/acrylic acid monomer second stage. Itaconic acid as 0.5 part is polymerized therewith as described hereinafter.

The first stage polymerization is externally seeded with a 0.0225 $\mu m$ average diameter lightly carboxylated polystyrene polymer latex in an amount corresponding to 0.19 parts per 100 parts of total monomer to be polymerized. The seed latex is added to an initial aqueous medium containing 0.5 part itaconic acid, 66 parts deionized water and 0.03 part chelating agent (i.e., the pentasodium salt of diethylenetriamine penta-acetic acid). During monomer addition the reaction mixture is agitated at a rate of 215 rpm under nitrogen purge.

An additional aqueous stream containing 12 parts distilled water, 0.48 part sodium dodecyldiphenyl oxide sulfonate, 0.23 part sodium hydroxide and 1.16 part sodium persulfate is added to the aforementioned initial aqueous medium continuously over a 4.5 hour period which addition commences 5 minutes after the first polymer feed commences.

The first stage monomer addition is added to the initial aqueous medium in a continuous manner over a 2.7 hour period while the reaction mixture is held at 97° C. The monomer addition comprises 3 separate feeds, each containing one of 53.5 parts styrene, 17.8 parts butadiene, and 0.9 part acrylic acid and 0.9 part carbon tetrachloride.

Following complete addition of the first stage monomer addition is added a second stage monomer addition in a continuous manner over a 1.3 hour period while the reaction mixture is held at 97° C. The monomer addition comprises 3 separate feeds, each containing one of 15.5 parts styrene, 11.2 parts butadiene, and 0.6 part acrylic acid and 0.6 part carbon tetrachloride.

Following complete addition of the second stage monomer addition, about a 30 minute cookdown is provided after which the latex is stream stripped in order to remove residual monomers and volatile organic substances. The resulting latex contains 56 percent solids having heterogeneous polymer particles having an average particle size of 2100 Å.

A homogeneous small size polymer latex having an average particle size of 700 Å and 43 percent solids is prepared by adding to an initial aqueous medium containing 115 parts deionized water, 0.5 part itaconic acid, 4.75 parts of 0.0225 μm average diameter lightly carboxylated polystyrene polymer seed latex and 0.03 part chelating agent. During monomer addition the reaction mixture is agitated at a rate of 215 rpm under nitrogen purge.

An additional aqueous stream containing 12 parts distilled water, 1.16 parts sodium persulfate, 0.23 part sodium hydroxide and 0.48 part sodium dodecyldiphenyl oxide sulfonate is added to the aforementioned initial aqueous medium continuously 5 minutes after the hereinafter described monomer feed is commenced and is continued for a 4.5 hour period.

The monomer addition is added to the initial aqueous medium in a continuous manner over a 5 hour period while the reaction mixture is held at 92° C. The monomer addition comprises one feed containing 61 parts styrene, 34 parts butadiene, 4.5 parts acrylic acid and 3 parts carbon tetrachloride.

Following complete addition of the monomer feed, a 30 minute cookdown is provided after which the latex is steam stripped to remove residual monomers and volatile organic substances.

The latex compositions comprising the 2100 Å large size heterogeneous particles and the 700 Å small size particles are blended together in order to provide 70 parts large size particles and 30 parts small size particles. The mixture is concentrated using a Rinco rotary evaporator to provide a latex formulation having 60 percent solids.

The bimodal latex formulation is compounded into a coating composition with Number 1 clay pigment, calcium carbonate and starch. The coating composition has 67 percent total solids, which solids are 14 parts latex solids, 2 parts starch, 80 parts clay and 20 parts calcium carbonate. The formulation which exhibits a viscosity of 65 cps using a Hi-Shear Hercules viscometer using E-bob and 400,000 dynes/cm spring and is designated as Sample 1.

Sample C-1 is a comparative sample and contains a monodisperse carboxylated styrene/butadiene type latex having an average polymer particle size of 1300 Å which is commercially available as DL-640 from The Dow Chemical Company. Sample C-1 is a comparative coating formulation containing 67 percent solids, which solids are 14 parts latex solids, 2 parts starch, 80 parts clay pigment and 20 parts calcium carbonate. The formulation exhibits a viscosity of 63 cps using a Hi-Shear Hercules viscometer using E-bob and 400,000 dynes/cm spring.

The Samples are applied as a coating to ground wood pulp using an inverted tube blade coater.

Data concerning the coating properties of Sample 1 and Sample C-1 are presented in Table I.

TABLE I

COATED PAPER PROPERTIES

| Coating Property | Coating Composition Binder | |
|---|---|---|
| | Sample C-1* | Sample 1 |
| Coat Weight (lbs/3300 ft$^2$) | 9 | 9 |
| Tappi 75° Sheet Gloss (800 psi/125° F.) | | |
| Initial (0 nips) | 25 | 35 |
| Final (3 nips) | 69 | 76 |
| Sheffield Porosity | 36 | 61 |
| Ink Gloss (Red-Heat Set) | 80.5 | 85.5 |
| K & N Ink Receptivity (percent drop in brightness) | 16.9 | 22.1 |
| Brightness | 80.5 | 79.7 |
| IGT Dry Pick | 254 | 256 |

*Not an example of the Invention

The data in Table I indicate that at comparable coat weights, the coating formulation of this invention (Sample 1) exhibits superior gloss, porosity and ink receptivity compared to the comparative sample (Sample C-1). Such properties are exhibited by Sample 1 while binding strength and brightness are comparable to Sample C-1.

COMPARATIVE EXAMPLES

The latex of Sample C-1 is formulated in order to provide a 67.4 percent solid formulation containing 14 parts latex solids and 100 parts clay. The formulation exhibits a viscosity of 40 cps, as determined as described hereinbefore.

In a similar manner are provided Comparative Samples C-2 and Sample C-3. Sample C-2 is 67.2 percent solids and exhibits a viscosity of 38 cps. Sample C-3 is 67.6 percent solids and exhibits a viscosity of 43 cps as determined as described hereinbefore.

Sample C-2 contains a monodisperse carboxylated styrene/butadiene type latex having an average polymer particle size of 1300 Å which is commercially available as DL-638 from The Dow Chemical Company.

Sample C-3 contains a bimodal latex composition of the type employed in U.S. Pat. No. 4,474,860. The sample is provided by blending 75 parts of 2100 Å polymer particles with 25 parts of 700 Å polymer particles. The latex formulation is concentrated using a Rinco rotary evaporator. The large polymer particles comprise 63 percent styrene, 35 percent butadiene, 0.5 percent itaconic acid and 1.5 percent acrylic acid polymerized using conventional emulsion polymerization techniques in order to provide polymer particles of an essentially non-heterogeneous character. The small polymer particles comprise 61 percent styrene, 34 percent butadiene, 0.5 percent itaconic acid and 4.5 percent acrylic acid polymerized using conventional emulsion polymerization techniques. The bimodal latex formulation exhibits a solids content of 60 percent after concentration.

The samples are applied to wood pulp as a coating to ground wood pulp using an inverted tube blade coater.

Data concerning the comparative samples are presented in Table II.

TABLE II

Comparative Data - Coated Paper Properties

| Coating Property | Coating Composition Binder | | |
|---|---|---|---|
| | Sample C-1* | Sample C-2* | Sample C-3* |
| Coat Weight (lbs/3300 ft$^2$) | 8.4 | 8.6 | 8.3 |

TABLE II-continued

| Comparative Data - Coated Paper Properties | | | |
|---|---|---|---|
| | Coating Composition Binder | | |
| Coating Property | Sample C-1* | Sample C-2* | Sample C-3* |
| Tappi 75° Sheet Gloss (800 psi/125° F.) (3 nips) | 76.2 | 71.7 | 71.8 |
| Sheffield Porosity | 14.0 | 5.5 | 17.5 |
| K & N Ink Receptivity (percent drop in brightness) | 7.1 | 7.1 | 5.4 |
| Brightness | 75.6 | 75.4 | 75.3 |
| IGT Dry Pick | 136 | 187 | 150 |

*Not an example of the invention.

The data in Table II indicate that gloss exhibited by Sample C-1 is superior to the other comparative samples. For this reason, the polymer latex of Sample C-1 is employed as a comparative sample in Table I.

What is claimed is:

1. A high solids formulation for coating paper which comprises an aqueous medium having dispersed therein a functionally effective amount of a finely divided mineral filler and a high solids synthetic bimodal latex comprising two separate and distinct particle size distributions and comprising in polymerized form open chain conjugated diene and alkenyl mononuclear aromatic monomers; wherein each of said distributions comprises particles which are substantially uniform in diameter such that said latex, when mixed with said filler in said aqueous medium, provides a coating formulation which approaches a viscosity which is no longer manageable at a higher solids content than that solids content exhibited by a formulation comprising an aqueous medium, a filler and a monodisperse or highly multi-disperse latex; whereby the small latex particles of said distribution of the bimodal latex provides an increase in the solids content and a decrease in viscosity at high shear of the formulation over that of a formulation comprising a monodisperse latex of a particle size similar to that of the large latex particle distribution of the bimodal latex; and whereby the large latex particle distribution of the bimodal latex are heterogeneous in nature and are capable of increasing the solids content of the formulation at low shear over that of a formulation comprising a monodisperse latex of a particle size similar to that of the small latex particle distribution of the bimodal latex.

2. A formulation of claim 1 wherein the latex has a particle size of said two separate and distinct distributions are in the range from about 500 Å to about 1000 Å and from about 1500 Å to about 10,000 Å in diameter, respectively.

3. A formulation of claim 1 comprising a bimodal latex wherein the small polymer particles comprise a styrene/butadiene, styrene/butadiene/acrylic acid, styrene/butadiene/vinylidene chloride latex, styrene/-butadiene/β-hydroxyethyl acrylate, styrene/-butadiene/β-hydroxyethylacrylate/acrylic acid, styrene/-n-butylacrylate/acrylic acid, methylmethacrylate/-n-butylacrylate/acrylic acid and/or vinyl acetate/-n-butylacrylate/acrylic acid.

4. A formulation of claim 1 comprising a styrene/-butadiene/acrylic acid/itaconic acid containing polymer particle bimodal latexes.

5. A process for coating paper which comprises applying the formulation of claim 1 to paper.

6. A process for coating paper which comprises applying the formulation of claim 1 to paper using a blade coater.

7. A coated article comprising a fibrous sheet continuously coated on at least one surface with the formulation of claim 1.

8. A formulation of claim 1 wherein the latex has a particle size of said separate and distinct distributions are in the range from about 600 Å to about 800 Å and from about 1800 Å to about 3000 Å in diameter, respectively.

9. A formulation of claim 1 wherein the diameter of the large latex particles range from about 2.5 to about 10 times the diameter of the small latex particles.

10. A formulation of claim 1 wherein the diameter of the large latex particles range from about 3 to about 4 times the diameter of the small latex particles.

11. A formulation of claim 1 wherein said bimodal latex comprises from about 50 to about 98 weight percent large size particles and from about 2 to about 50 weight percent small size particles.

12. A formulation of claim 1 wherein said bimodal latex comprises from about 60 to about 80 weight percent large size particles and from about 20 to about 40 weight percent small size particles.

13. A formulation of claim 1 wherein said formulation has a solids content of from about 60 to about 75 weight percent based on the total weight of the formulation.

14. A formulation of claim 13 wherein said solids content comprises about 100 parts filler and from about 2 to about 20 parts bimodal latex.

15. A composition comprising an aqueous medium having dispersed therein a synthetic bimodal polymer latex comprising two separate and distinct particle size distributions of large size particles and small size particles, wherein each of said distributions comprises particles which are of a substantially uniform diameter; wherein the large size particles comprise particles which are heterogeneous in nature having a soft polymer domain and a hard polymer domain.

16. The composition of claim 15 wherein said large size particles comprise from about 10 to about 90 weight percent hard polymer domain, and from about 10 to about 90 weight percent soft polymer domain.

17. The composition of claim 15 wherein said large size particles comprise from about 40 to about 75 weight percent hard polymer domain, and from about 25 to about 60 weight percent soft polymer domain.

18. The composition of claim 15 wherein said large size particles comprise carboxylated monovinylidene/-conjugated diene containing polymer particles.

19. A formulation of claim 15 wherein the latex has a particle size of said two separate and distinct distributions are in the range from about 500 Å to about 1000 Å and from about 1500 Å to about 10,000 Å in diameter, respectively.

20. A formulation of claim 15 wherein the latex has a particle size of said separate and distinct distributions are in the range from about 600 Å to about 800 Å and from about 1800 Å to about 3000 Å in diameter, respectively.

21. A formulation of claim 15 wherein the diameter of the large latex particles range from about 2.5 to about 10 times the diameter of the small latex particles.

22. A formulation of claim 15 wherein the diameter of the large latex particles range from about 3 to about 4 times the diameter of the small latex particles.

23. A formulation of claim 15 wherein said bimodal latex comprises from about 50 to about 98 weight percent large size particles and from about 2 to about 50 weight percent small size particles.

24. A formulation of claim 15 wherein said bimodal latex comprises from about 60 to about 80 weight percent large size particles and from about 20 to about 40 weight percent small size particles.

* * * * *